US012070084B2

(12) United States Patent
Hess

(10) Patent No.: US 12,070,084 B2
(45) Date of Patent: Aug. 27, 2024

(54) GARMENT WITH DUAL CLOSURE CONFIGURATION

(71) Applicant: Oceeto LLC, Newark, DE (US)

(72) Inventor: Andrea C. Hess, Newark, DE (US)

(73) Assignee: Oceeto LLC, Newark, DE (US)

( * ) Notice: Subject to any disclaimer, the term of this patent is extended or adjusted under 35 U.S.C. 154(b) by 57 days.

(21) Appl. No.: 17/941,983

(22) Filed: Sep. 9, 2022

(65) Prior Publication Data

US 2023/0134607 A1 May 4, 2023

Related U.S. Application Data

(60) Provisional application No. 63/272,984, filed on Oct. 28, 2021.

(51) Int. Cl.
*A41B 1/10* (2006.01)
*A41D 13/12* (2006.01)

(52) U.S. Cl.
CPC ..... *A41B 1/10* (2013.01); *A41D 13/12* (2013.01); *A41D 2300/324* (2013.01)

(58) Field of Classification Search
CPC ..... A41B 1/10; A41B 13/005; A41B 13/06; A41B 13/08; A41D 13/1245; A41D 13/1272; A41D 13/129; A41D 15/005
See application file for complete search history.

(56) References Cited

U.S. PATENT DOCUMENTS

| | | | | |
|---|---|---|---|---|
| 1,218,307 | A * | 3/1917 | Page | A41B 13/08 2/111 |
| 2,635,243 | A | 4/1953 | Eskey | |
| 6,684,422 | B2 | 2/2004 | LeFevre et al. | |
| 7,207,070 | B1 | 4/2007 | Swarez-Ballesteros | |
| D549,967 | S | 9/2007 | Wing | |
| 7,316,035 | B2 | 1/2008 | Archambault | |
| 7,406,718 | B1 | 8/2008 | Ekelund et al. | |
| 7,409,727 | B2 | 8/2008 | Ekelund et al. | |
| 7,454,808 | B2 | 11/2008 | Parrilla | |
| D585,631 | S | 2/2009 | Barclay | |
| 7,640,598 | B1 | 1/2010 | Mallik | |
| D611,682 | S | 3/2010 | Cutler | |
| 7,703,159 | B2 | 4/2010 | Parrilla | |
| 7,765,609 | B2 | 8/2010 | Chase | |
| 7,784,108 | B2 | 8/2010 | Ekelund et al. | |
| D623,383 | S | 9/2010 | Rojas | |
| 7,805,770 | B2 | 10/2010 | Ekelund et al. | |
| 7,805,771 | B2 | 10/2010 | Ekelund et al. | |
| D627,951 | S | 11/2010 | Chesal et al. | |
| 7,827,618 | B2 | 11/2010 | Arthur-Mensah et al. | |
| D636,152 | S | 4/2011 | Watkins et al. | |
| 7,992,220 | B1 | 8/2011 | McGoldrick | |
| D651,786 | S | 1/2012 | Hessler | |
| 8,091,145 | B2 | 1/2012 | Ekelund et al. | |

(Continued)

*Primary Examiner* — Sally Haden
(74) *Attorney, Agent, or Firm* — Womble Bond Dickinson (US) LLP

(57) ABSTRACT

Exemplary garments may be reconfigurable into multiple closed positions. For example, in a first closed position, a first front panel of the garment may cover some or all of a second front panel; while in a second closed position, the second front panel may cover some or all of the first front panel. The first front panel and the second front panel may be releasably fastened together in both the first closed position and the second closed position.

19 Claims, 13 Drawing Sheets

(56) References Cited

U.S. PATENT DOCUMENTS

| | | | |
|---|---|---|---|
| 8,118,268 | B2 | 2/2012 | Mabry |
| 8,181,272 | B2 | 5/2012 | Lee |
| 8,196,222 | B2 | 6/2012 | Ekelund et al. |
| D666,791 | S | 9/2012 | Mancino |
| 8,584,262 | B2 | 11/2013 | Ekelund et al. |
| 8,661,565 | B2 | 3/2014 | Ekelund et al. |
| 8,707,467 | B2 | 4/2014 | Sohn |
| 9,095,181 | B1 | 8/2015 | Plant |
| 9,572,386 | B1 | 2/2017 | Scheer et al. |
| 10,893,722 | B2 | 1/2021 | Voda |
| 10,910,120 | B2 | 2/2021 | Glickman et al. |
| 2006/0059597 | A1 | 3/2006 | LaRocco |
| 2009/0000005 | A1 | 1/2009 | Amson |
| 2014/0143985 | A1 | 5/2014 | Horton |

* cited by examiner

GARMENT WITH DUAL CLOSURE CONFIGURATION

CROSS-REFERENCE TO RELATED APPLICATIONS

This application claims the benefit of U.S. Provisional Patent Application No. 63/272,984 filed Oct. 28, 2021, the entire contents of which are incorporated herein by reference.

BACKGROUND OF THE DISCLOSURE

Specialized garments may be worn by those who provide caregiver services to others, such as workers in healthcare settings, childcare, and the like, to help minimize potential exposure to contaminants and also to prevent spreading contaminants from one location or person to another location or person. Such specialized garments may also serve to prevent the clothing worn by the caregiver from being soiled or stained. For example, caregivers caring for babies, especially during nursing, feeding, and burping, may utilize specialized garments or devices that aim to help prevent or reduce stains and spills that result from a baby eating and spitting up. The current market solutions for spill/stain prevention fails to provide adequate surface coverage for a caregiver. As a result, the caregiver may need to change clothes after each feeding, which is especially cumbersome for caregivers that must provide childcare outside of the home where access to a new outfit is non-existent or limited. In addition, current market solutions for spill/stain coverage often require frequent changes between each feeding. Further, traditional garments associated with mealtime, such as nursing gowns or burp clothes, may not be appropriate for environments outside of the home, in which a caregiver would be more comfortable wearing a garment with concealed functionality for the above-mentioned childcare needs.

Accordingly, there is a need for a garment that adequately protects the caregiver from spills or stains. There is a further need for a garment that is suitable for repeated use by a caregiver, and which reduces the likelihood of damage to the user's clothes during use and/or does not require washing after each use. There is a further need for a garment that has concealed functionality such that the garment is appropriate for wear in environments outside of the home.

BRIEF DESCRIPTION OF THE EXEMPLARY EMBODIMENTS

Disclosed embodiments may comprise garments which may be reconfigurable into multiple closed positions. For example, in a first closed position, a first front panel of the garment may cover some or all of a second front panel; while in a second closed position, the second front panel may cover some or all of the first front panel. The first front panel and the second front panel may be releasably fastened together in both the first closed position and the second closed position. By using the reconfigurable nature of the garment (e.g. between the first closed position and the second closed position), a wearer may be able to extend wear of the garment even when soiled, for example by covering a soiled first front panel with an unsoiled second front panel, or vice versa. Such garment embodiments may be particularly helpful for caregivers, who may be exposed to soiling conditions.

According to an aspect, the exemplary garment embodiments include a first front panel, a second front panel, and a back panel. In some embodiments, each of the first front panel and the second front panel includes a neckline and a lower edge spaced apart from the neckline by a length, and each of the first front panel and the second front panel includes an interior portion adjacent a lateral side edge and a peripheral edge spaced apart from the lateral side edge by a width, with the interior portion of the first front panel permanently attached to a first side of the back panel and the interior portion of the second front panel permanently attached to a second (e.g. opposite) side of the back panel. In some embodiments, the width of each of the first front panel and the second front panel at the neckline is greater than the width at the lower edge. In some embodiments, the first front panel and the second front panel may be substantially identical mirror images of each other. The garment can be repositionable between a first closed position, in which the first front panel is releasably fastened to and covers at least a portion of the second front panel, and a second closed position in which the second front panel is releasably fastened to and covers at least a portion of the first front panel. In some embodiments, in both the first closed position and the second closed position, the garment substantially covers and/or enwraps a torso of a wearer.

In another aspect, the exemplary garment embodiments include a first front panel and a second front panel. In some embodiments, each of the first front panel and the second front panel includes a neckline and a lower edge spaced apart from the neckline by a length, and each of the first front panel and the second front panel includes an interior portion adjacent to a lateral side edge and a peripheral edge spaced apart from the lateral side edge by a width. The garment can be repositionable between a first closed position in which the first front panel is releasably fastened to and covers at least a portion of the second front panel, and a second closed position in which the second front panel is releasably fastened to and covers at least a portion of the first front panel. For example, each of the first front panel and the second front panel may include two releasable fasteners. In some embodiments, the two releasable fasteners for the first front panel may include a first double-button, having an exterior button stacked atop an interior button with the first panel disposed therebetween, and a first loop. The first double button may be disposed on the interior portion of the first front panel in proximity to the neckline, and the first loop may be disposed in proximity to the neckline and the peripheral edge of the first front panel. Likewise, in some embodiments the two releasable fasteners for the second front panel may include a second double-button, having an exterior button stacked atop an interior button with the second panel disposed therebetween, and a second loop. The second double-button may be disposed on the interior portion of the second front panel in proximity to the neckline, and the second loop may be disposed in proximity to the neckline and the peripheral edge of the second front panel. In some embodiments, the first double-button may be configured to releasably fasten to the second loop in both the first closed position and the second closed position, and the first loop may be configured to releasably fasten to the second double-button in both the first closed position and the second closed position.

In another aspect, the exemplary embodiments include garments having a first front panel, a second front panel, a first arm, and a second arm. In some embodiments, each of the first front panel and the second front panel includes a neckline and a lower edge spaced apart from the neckline by a length, and each of the first front panel and the second front panel includes an interior portion adjacent a lateral side edge and a peripheral edge spaced apart from the lateral side edge by a width. The first arm may be disposed in proximity to the interior portion of the first front panel, and the second arm may be disposed in proximity to the interior portion of the second front panel. In some embodiments, the garment may be repositionable between a first closed position in which the first front panel is releasably fastened to and covers at least a portion of the second front panel, and a second closed position in which the second front panel is releasably fastened to and covers at least a portion of the first front panel.

BRIEF DESCRIPTION OF THE DRAWINGS

A more particular description will be rendered by reference to exemplary embodiments that are illustrated in the accompanying figures. Understanding that these drawings depict exemplary embodiments and do not limit the scope of this disclosure, the exemplary embodiments will be described and explained with additional specificity and detail through the use of the accompanying drawings in which.

Figure 1:
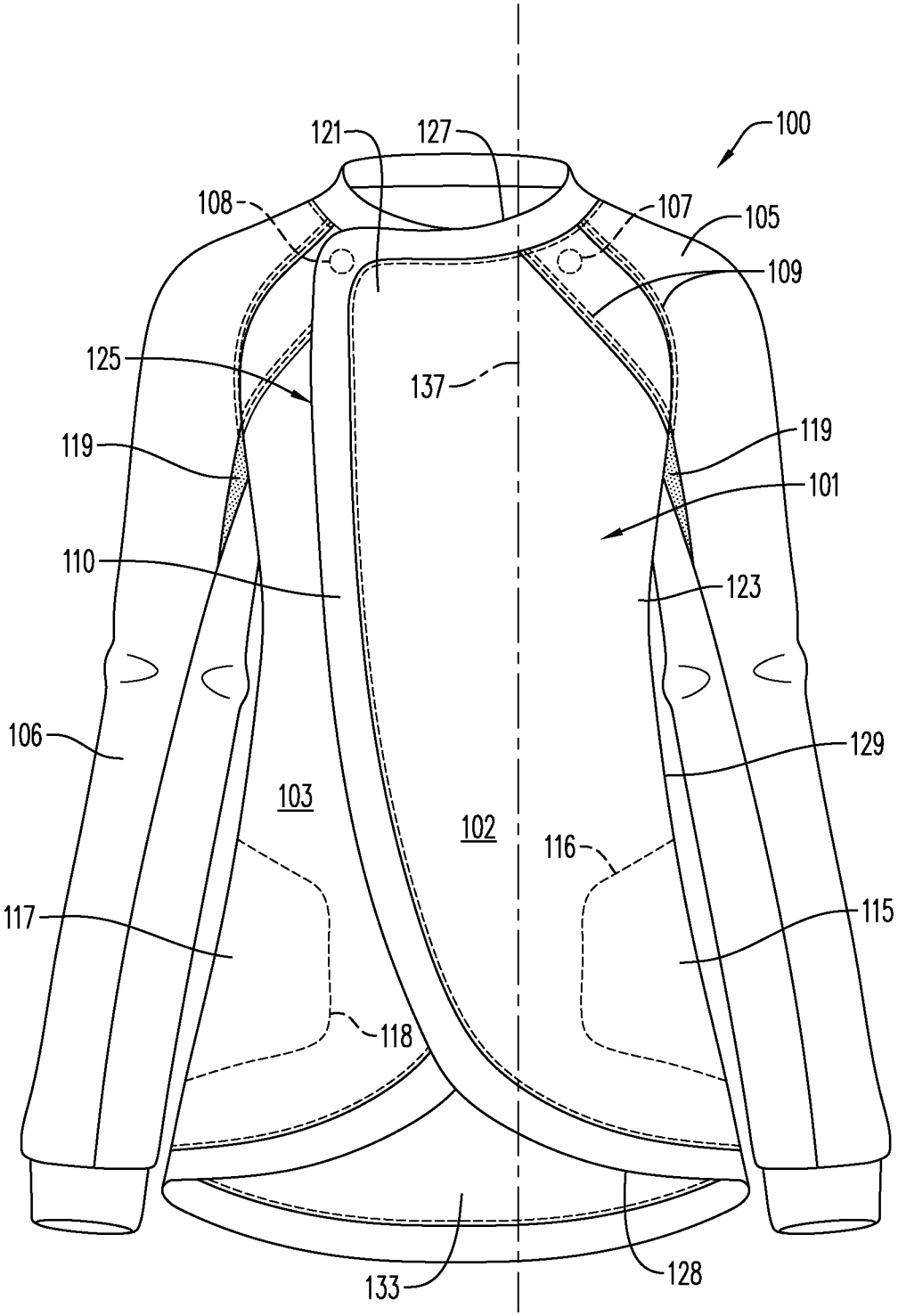
FIG. 1 is a front view of an exemplary garment, according to an aspect and in a first closed position.

Various features, aspects, and advantages of the exemplary embodiments will become more apparent from the following detailed description, along with the accompanying drawings in which like numerals represent like components throughout the figures and detailed description. The various described features are not necessarily drawn to scale in the drawings but are drawn to aid in understanding the features of the exemplary embodiments.

The headings used herein are for organizational purposes only and are not meant to limit the scope of the disclosure or the claims. To facilitate understanding, reference numerals have been used, where possible, to designate like elements common to the figures.

DETAILED DESCRIPTION

Reference will now be made in detail to various exemplary embodiments. Each example is provided by way of explanation and is not meant as a limitation and does not constitute a definition of all possible embodiments. It is understood that reference to a particular "exemplary embodiment" of, e.g., a structure, assembly, component, configuration, method, etc. includes exemplary embodiments of, e.g., the associated features, subcomponents, method steps, etc. forming a part of the "exemplary embodiment".

Figure 2:
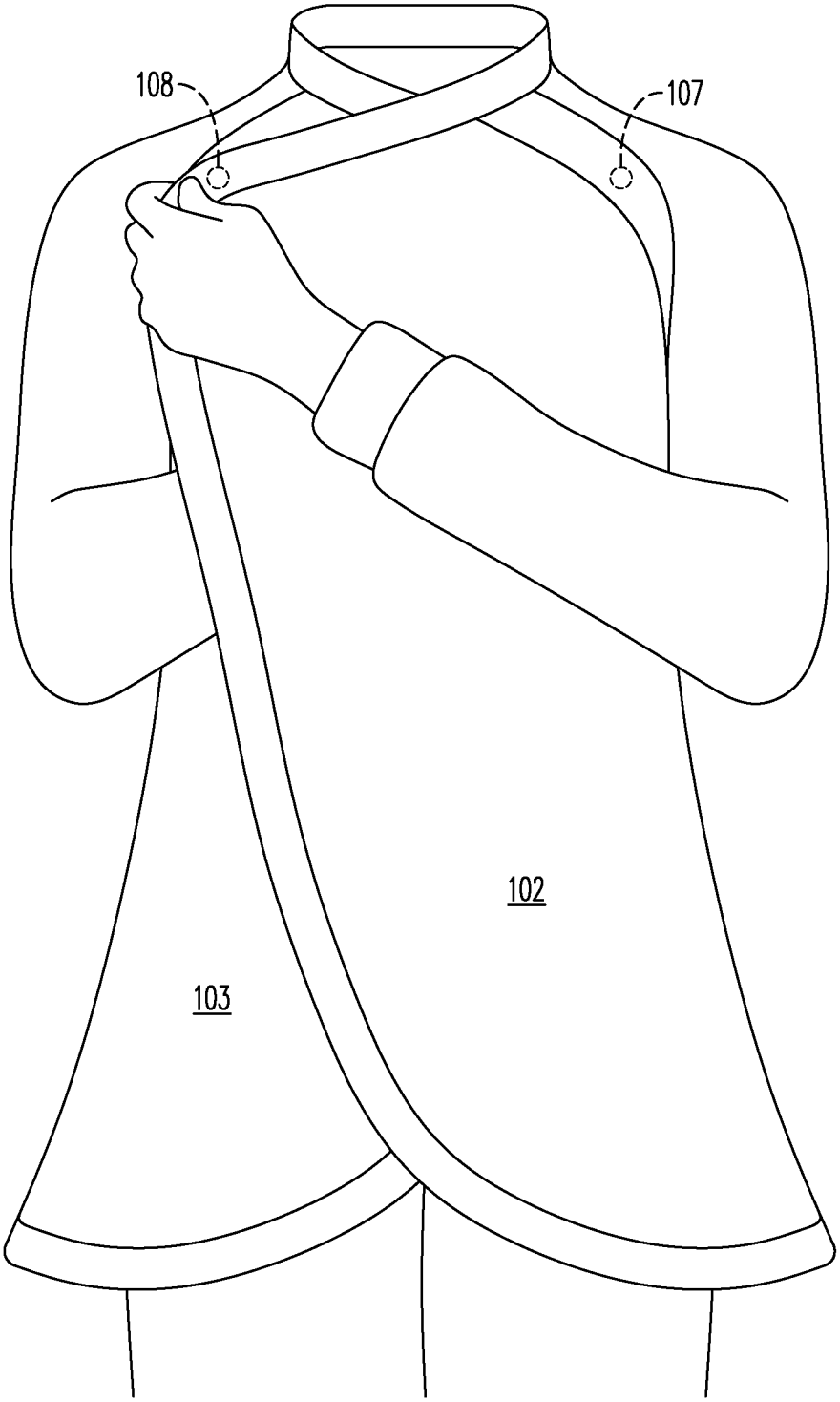
FIG. 2 is a front view of the exemplary garment according to an embodiment in a first closed position according to an aspect.

FIGS. 1 and 2 show a garment/dual closure garment 100 that may be worn by those who provide care to others, whether personally or professionally. According to an aspect, the garment 100 may be configured for use by a caregiver caring for another person, e.g., an infant, toddler, or any individual. Such caregivers may be susceptible to spills or stains, for example, that can occur during or after mealtime.

In the exemplary embodiment of FIG. 1, the garment 100 includes a body portion 101. The body portion 101 may include a first front panel 102 and a second front panel 103. For example, each of the first front panel 102 and the second front panel 103 may have a free end portion 121 and an interior portion 123, for example disposed on opposite sides of the panel. For both the first front panel 102 and the second front panel 103, the free end portion 121 may be disposed in proximity to a peripheral edge 125 of the panel. For example, the free end portion 121 may abut and/or be disposed adjacent to the peripheral edge 125 as it extends downward from the neckline 127 towards the lower edge 128. In some embodiments, the free end portion 121 may extend inward from the peripheral edge 125, for example ending at, adjacent to, or in proximity to the interior portion 123. In some embodiments, the free end portion 121 may extend inward several inches (e.g. 2-3 inches, 2-5 inches, 3-6 inches, up to ¼ of the width of the front panel, up to ⅓ the width of the front panel, up to ½ the width of the front panel, up to ⅔ the width of the front panel, or up to ¾ the width of the front panel in various embodiments) from the peripheral edge 125 of a front panel. In some embodiments, the interior portion 123 is disposed in proximity to and/or adjacent to the lateral side edge (for example shown in FIG. 1 with regard to the first front panel as 129) of the relevant front panel, which may be a seam in which the interior portion connects to a back panel in some embodiments (e.g. under the arms), may be disposed at the point of connection of the arm or substantially in a vertical line extending therefrom in some embodiments, may be an edge of the front panel opposite the peripheral edge 125 (e.g. separated by the width of the front panel), and/or may be a line of attachment of the front panel to the back panel in some embodiments. The interior portion 123 may extend outward in some embodiments into proximity with or adjacent to the free end portion 121. For example, the interior portion 123 may extend outward from the lateral side edge 129 for several inches (e.g. 2-3 inches, 2-5 inches, 3-6 inches, up to ¼ of the width of the front panel, up to ⅓ the width of the front panel, up to ½ the width of the front panel, up to ⅔ the width of the front panel, or up to ¾ the width of the front panel) in some embodiments.

In some embodiments, the first front panel 102 and the second front panel 103 may be linked, for example permanently attached, by connection of their respective interior portions 123. For example, the interior portion 123 of the first front panel 102 may be attached to a back panel 133 on a first side, and the interior portion 123 of the second front panel 103 may be attached to the back panel 133 on a second side (e.g. opposite the first side of the back panel), For example, the first front panel 102, second front panel 103, and back panel 133 may form the garment 100 body portion configured to wrap around the torso of the wearer. As used herein, the free end portion 121 of a front panel may be considered free by not being permanently attached directly to another panel of the garment (e.g. as opposed to the interior portion 123 which is permanently attached to the back panel), such that in an open position of the garment, the free end portion 121/peripheral edge 125 of a front panel may hang completely freely and/or in a closed position the free end portion 121/peripheral edge 125 may be capable of being opened (e.g. to place the garment in an open position). In some embodiments, the back panel 133 may include multiple panels. In some embodiments, the back panel 133 may have a length at least as long as the length of the first front panel and the second front panel, while in other embodiments the back panel 133 may have a length that is greater than half (½) the length of the front panels but no more than 1.5 times the length of the front panels (e.g. from about 0.5-1.5 the length of a front panel)). In some embodiments, the back panel may comprise a neckline and a lower edge spaced apart from its neckline (e.g. by its length).

In some embodiments, the neckline 127 of each of the first front panel 102 and the second front panel 103 may be disposed at the top of the garment 100 (e.g. extending from a shoulder portion to the free end portion peripheral edge 125). In some embodiments, the neckline 127 of each front panel may be disposed approximately at shoulder level or above (e.g. forming a high neckline with coverage up to or in proximity with the wearer's neck). Each of the first front panel 102 and the second front panel 103 may extend (e.g. the length of the garment and/or the front panel) from their neckline 127 to their lower edge 128. In some embodiments, the lower edge 128 may include or consist essentially of a substantially horizontal edge of the front panel (e.g. no more than 30 degrees, no more than 20 degrees, or no more than 15 degrees from flat horizontal) and/or may be disposed at the bottom of the garment, opposite and/or distal the neckline 127 (e.g. spaced apart from the neckline by the length). In some embodiments, the lower edge 128 may be configured to extend in proximity to the waistline of the wearer or below (e.g. between the waistline and the knees or between the hips and the knees of a typical wearer for whom the garment has been sized). In some embodiments, the lower edge 128 may be disposed below the waistline of the garment 100. The width of each front panel may extend from the peripheral edge 125 to the lateral side edge 129. In some embodiments, the width of each of the first front panel 102 and the second front panel 103 at the neckline 127 (e.g. with the width at the neckline extending from the peripheral edge at the neckline to the lateral side and/or shoulder) may be greater than its width at the lower edge 128 (e.g. with the width at the lower edge extending from the peripheral edge at the lower edge to the lateral side). For example, the peripheral edge 125 of each of the first front panel 102 and the second front panel 103 may form a continuous curve from the neckline 127 to the lower edge 128 (e.g. curving from the wider neckline to the narrower lower edge). In some embodiments, the free end portion 121 may curve and/or narrow as it extends downward from the neckline 127 (e.g. at the peripheral edge) towards the interior portion lower edge 128 and/or back panel 133. In some embodiments, the interior portion 123 of each front panel may have a substantially consistent width along its length, while the free end portion 121 may have a greater width in proximity to the neckline 127 and a smaller width in proximity to the lower edge 128 (e.g. varying along its length). For example, the width of the free end portion 121 may vary continuously from the greater width at the neckline 127 to the smaller width at or near the lower edge 128.

In some embodiments, the first front panel 102 and the second front panel 103 may be substantially symmetrical (e.g. mirror images of each other, for example about a longitudinal center axis of the body portion 101). In some embodiments, the entire garment 100 may be substantially symmetrical about the longitudinal center axis of the body portion 101. The first front panel 102 free end 121 and/or peripheral edge 125 may not be permanently attached to the second front panel 103 and/or the second front panel 103 free end 121 and/or peripheral edge 125 may not be permanently attached to the first front panel 102. Rather, in one or more closed positions, the first front panel 102 may be releasably and/or removably fastened directly to the second front panel 103 and/or vice versa. In both the first closed position and the second closed position, the neckline of the garment (e.g. the joint neckline of the first front panel, the second front panel, and the back panel) may be configured to encircle a neck of a wearer. For example, the neckline 127 of the first front panel 102 and the second front panel 103 may be configured to overlap in both the first closed position and the second closed position. In some embodiments, the lower edge 128 of the first front panel 102 and the second front panel 103 may be configured to be non-overlapping in both the first closed position and the second closed position (e.g. with the front panels only overlapping at portions above the lower edges). In one or more open positions, at least the free end 121 of the first front panel 102 may not be directly attached/fastened to the second front panel 103 and/or at least the free end of the second front panel 103 may not be directly attached/fastened to the first front panel 102. In some embodiments, there may be no direct attachment/fastening of the first front panel 102 to the second front panel 103 (or vice versa) in an open position. For example, in an open position, there may be a gap between the free end 121 of the first front panel 102 and the free end of the second front panel 103, for example partially or fully exposing the wearer's chest (e.g. while the user's back and/or arms remain covered by the garment). In some embodiments, in an open position the neckline of the garment may not completely encircle a wearer's neck.

In a first closed position, as shown in FIGS. 1 and 2, the first front panel 102 may be the outermost layer of the garment 100 from the wearer's body on the front. In other words, the first front panel 102 may be positioned over and cover at least a portion of the second front panel 103. For example, in the closed position, the first front panel 102 may be configured to cover all, at least 90%, at least 80%, at least 70%, at least 50%, about 50-90%, about 50-80%, about 50-70%, about 70-90%, about 70-80%, about 80-90%, about 75-95%, about 80-95%, about 80-100%, or about 90-100% of the second front panel 103 in various embodiments. In some embodiments, in the first closed position, the first front panel 102 completely covers the entire free end portion 121 of the second front panel 103 and/or the entire peripheral edge 125 of the second front panel 103. In some embodiments, in the first closed position, the first front panel 102 may cover substantially the entire free end portion 121, substantially the entire top half of the free end portion 121, and/or substantially the entire peripheral edge 125 of the second front panel 103. In some embodiments, in the first closed position, the first front panel 102 may not cover any substantial amount of the interior portion 123 of the second front panel 103 (e.g. the interior portion of the second front panel may be substantially uncovered in the first closed position). In the second closed position (discussed in more detail below and shown in FIG. 5, for example), the second front body panel 103 may be configured to cover the first front body panel 102 in similar fashion.

In some embodiments, the body portion 101 may include a first arm receiving portion or arm 105 provided adjacent to the first front panel 102, and a second arm receiving portion or arm 106 provided adjacent to the second front panel 103. The arm receiving portions 105, 106 may each be a full-length sleeve into which the wearer's arm can be inserted and positioned during wear. It is contemplated, however, that the arm receiving portions 105, 106 may cover less than the full-length of the wearer's arm. In some instances, the arm receiving portion may include a shoulder portion, for example attached to the upper end of the interior portion of each of the first front panel 102 and the second front panel 103 in proximity to the neckline 127 and/or the lateral side (e.g. adjacent to or contacting the lateral side). In some embodiments, the sleeve may extend outward/downward from the shoulder portion. In some embodiments, the arm receiving portion 105, 106 may only include the shoulder portion (e.g. the garment may be sleeveless). In some embodiments, the sleeve of each arm receiving portion 105, 106 may have a cuff (e.g. an elasticized portion) opposite the shoulder portion (e.g. distally disposed on the sleeve).

The first front panel 102 may include a first pocket 115 defined by a first pocket seam 116, and/or the second front panel 103 may include a second pocket 117 defined by a second pocket seam 118. Each of the first pocket 115 and/or the second pocket 117 may be configured to receive and secure items. In some embodiments, one or both of the pockets may be disposed on the exterior (outward facing) surface of the front panels. In some embodiments, one or both of the pockets may be disposed on the interior (inward facing) surface of the front panels. In some embodiments, one or both of the front panels may have both interior and exterior pockets. Gussets 119 may be provided at the intersection of the first front panel 102 and arm receiving portion 105, and at the intersection of the second front panel 103 and arm receiving portion 106 (e.g. under the shoulder portion). The gussets 119 may add breadth and provide stretch to the garment 100 to afford a comfortable fit to the wearer through changes in the size and/or figure of the wearer.

Figure 5:
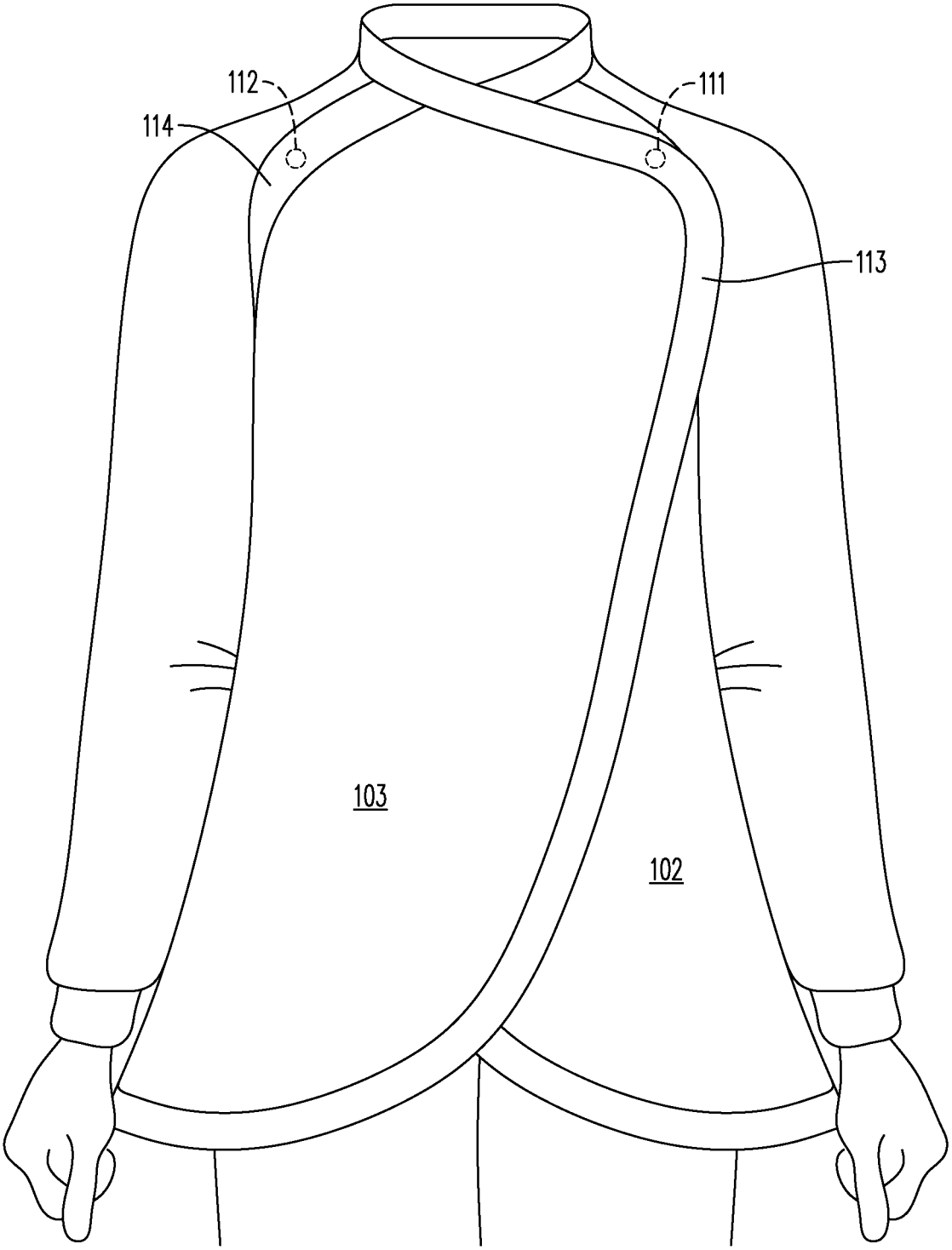
FIG. 5 is a front view of the exemplary garment of FIG. 2, in a second closed position according to an aspect.

The garment 100 may be configured to have two closed positions, a first closed position with the first front panel 102 fully exposed and/or the second front panel 103 at least partially covered by the first front panel 102 (see for example FIGS. 1 and 2), and a second closed position with the second front panel 103 fully exposed and/or the first front panel 102 at least partially covered by the second front panel 103 (see for example FIG. 5). In some embodiments, the second closed position may be similar to the first closed position (e.g. mirror images, with the position of the first front panel 102 and the second front panel 103 being swapped). One or more releasable attachment/fastening mechanisms (e.g. fasteners) may be located on each of the first front panel 102 and the second front panel 103, for securing the garment 100 in the first and/or second closed positions. In some embodiments, the releasable fasteners may be disposed in proximity to the neckline 127 of the front panels. For example, each of the first front panel 102 and the second front panel 103 may have an interior fastener and a free edge fastener. The free edge fastener may be disposed on the free end portion 121 of the front panel, for example in proximity and/or adjacent to the peripheral edge 125 and/or the neckline 127 (e.g. disposed no more than one or two inches from the peripheral edge and/or the neckline). The interior fastener may be disposed on the interior portion 123 of the front panel, for example in proximity and/or adjacent to the shoulder/arm receiving portion 105, 106 and/or the neckline 127. For example, in some embodiments, the interior fastener may be disposed no more than one or two inches from the neckline in the upper area of the interior portion 123 of the front panel.

In some embodiments, the garment 100 may be configured so that the free edge fastener may be disposed approximately in vertical alignment with one side of the wearer's neck (e.g. when the garment is being worn), while the interior fastener may be disposed approximately in vertical alignment with another side of the wearer's neck. In some embodiments, when the garment 100 is in a closed position (e.g. having a closed neckline for encircling the wearer's neck), the free edge fastener may be vertically aligned with one side of the closed neckline of the garment, while the interior fastener may be vertically aligned with another side of the closed neckline of the garment (as shown in FIG. 1, for example). In some embodiments, the interior portion 123 of the panel may extend outward from the lateral side to just beyond the location of the interior fastener. For example, the demarcation between interior portion 123 and free end portion 121 of a front panel may be approximately a vertical line (shown for example as demarcation line 137 in FIG. 1 for the first front panel, which may be substantially parallel to the longitudinal centerline of the garment) disposed outwardly adjacent to the interior fastener of the front panel. For each front panel, the interior fastener may be spaced from the free end fastener. For example, for each front panel the interior fastener and the free end fastener may be disposed in proximity to the neckline (e.g. less than 1 or 2 inches from the neckline) and/or may be configured so that in the closed position (e.g. as shown in FIG. 1) they are approximately aligned horizontally (e.g. forming a line therebetween which may be approximately perpendicular to the longitudinal centerline of the garment. In some embodiments, there may be no other attachment/fastening mechanisms. In some embodiments, the lower edge 128 of the front panels may be unattached (e.g. free to swing/move/hang freely, even in the closed position). In some embodiments, the only fastening of the front panels together (e.g. with respect to the free end/peripheral edge) may be in proximity to the neckline 127. In some embodiments, the only fastening of front panels together (e.g. in a closed position) may be in a top/upper portion or area of the front panels (e.g. in proximity to the neckline), with the remainder of the front panels (e.g. a lower portion or area of the front panels) being unfastened and/or able to hang or swing freely (e.g. even when the upper portion is fastened in a closed position).

Figure 3:
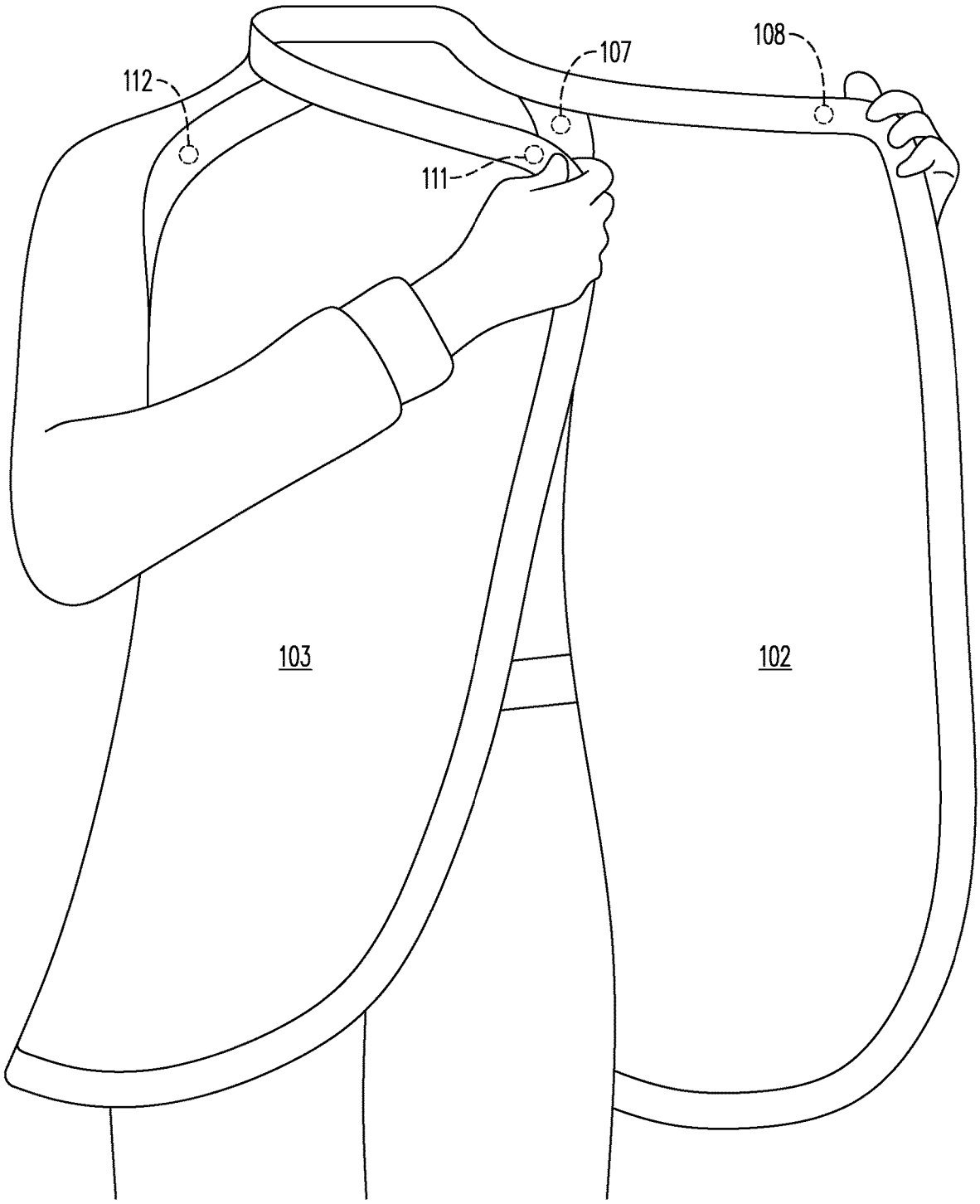
FIG. 3 is a front view of the exemplary garment of FIG. 2, in a first open position according to an aspect.
Figure 4:
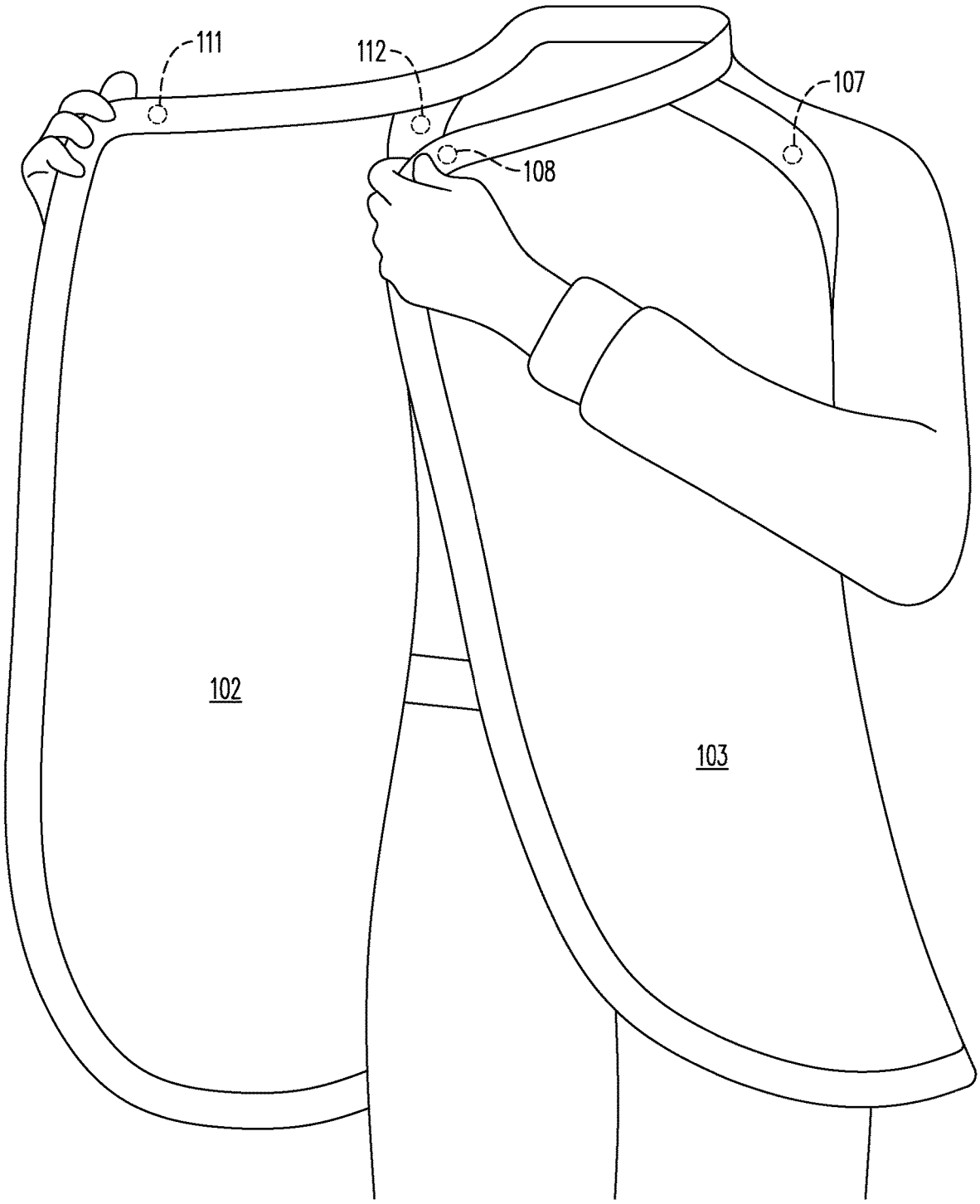
FIG. 4 is a front view of the exemplary garment of FIG. 2, in a second open position according to an aspect.
Figure 7:
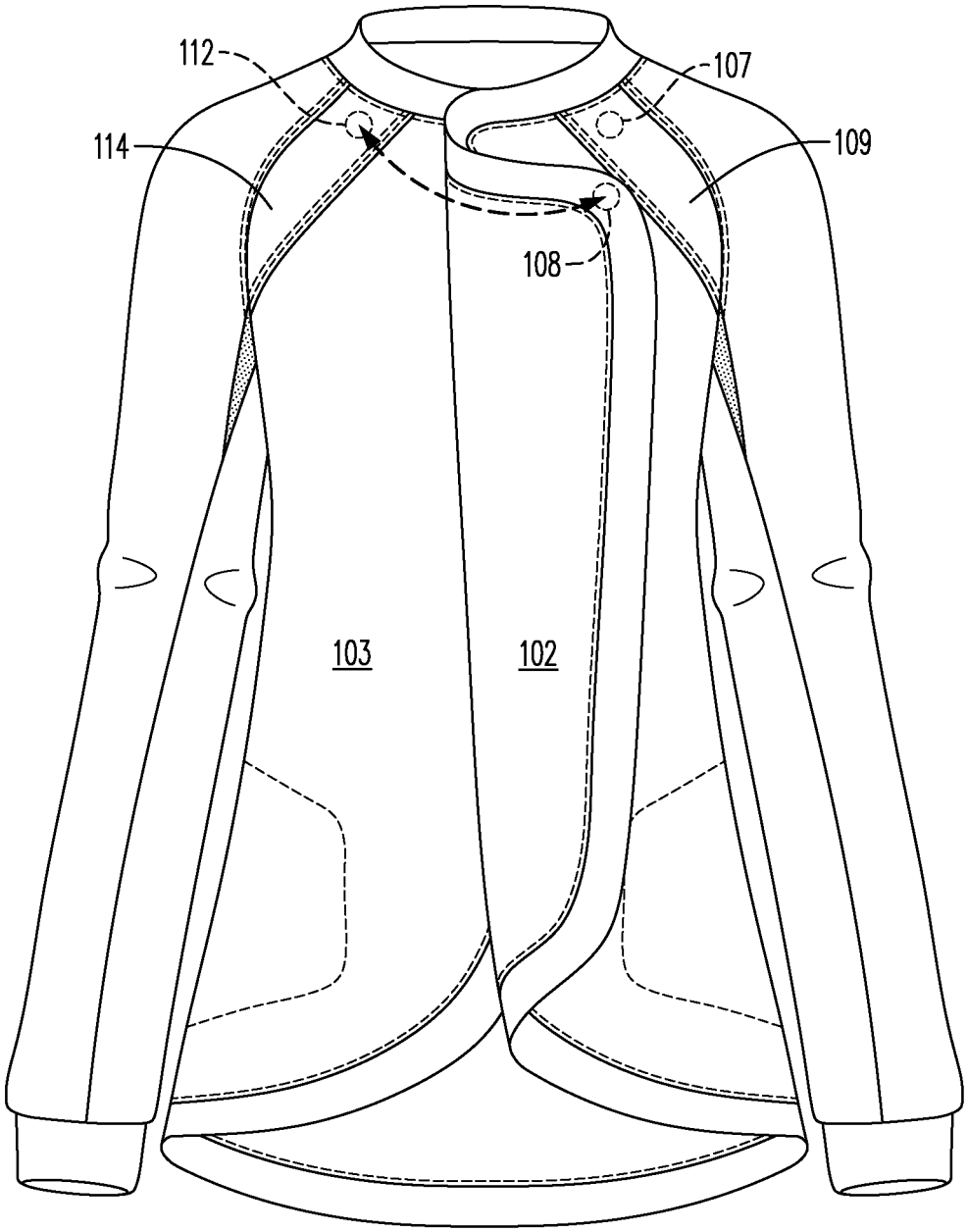
FIG. 7 is a front view of the exemplary garment illustrated in FIG. 1 according to an aspect in a first open position.

In some embodiments, the garment may also be configured with one or more open positions (e.g. as shown in FIGS. 3, 4, and 7). For example, in the open positions, the releasable fastening mechanisms may be unfastened/released, so that the free end 121 and/or peripheral edge 125 of both the first front panel 102 and the second front panel 103 are unattached to each other and/or free to swing/move/hang and/or be repositioned. In some embodiments, there may be a gap formed between the first front panel 102 and the second front panel 103 in either open position (e.g. between the free end portions/peripheral edge of the first front panel 102 and the second front panel 103 and/or between the free end portions/peripheral edge of the second front panel 103 and the first front panel 102). In some embodiments, the open position(s) may allow the front panels to be moved/repositioned with respect to one another, for example being pulled apart from one another and/or moved from one closed position to another closed position. Opening the front panels may also assist in venting heat while the wearer still wears the garment, which may help cool the wearer.

As shown in FIG. 1, the garment 100 features a dual closure system (i.e., a butterfly closure) near the wearer's neck, which includes a first panel interior fastening mechanism or fastener 107 and a first panel free edge fastening mechanism of fastener 108 provided on the first front panel 102 (and note, the terms fastener and fastening mechanism are used interchangeably herein). Details of the manufacture and arrangement of the fastening mechanisms and dual closure system within the garment 100 are described below with reference to FIG. 6. The arrangement of the dual closure system provides substantial coverage to the wearer (e.g. substantially the entire torso of the wearer may be covered), as well as a maximized surface area to conceal a spilled or stained portion of the garment 100. For example, if the wearer is wearing the garment 100 as shown in FIGS. 1 and 2 in a first closed position, and the first front panel 102 becomes soiled, the wearer can open and reposition the garment (see FIGS. 3 and 7 showing the garment 100 in a first open position and FIG. 4 showing the garment 100 in a second open position) to a second closed position, shown in FIG. 5, providing the second front panel 103 as a clean outermost surface and concealing the soiled portion of the first front panel 102 behind the second front panel 103. This provides the user with multiple wears of the garment 100 even though the garment 100 may be partially soiled. The wearer may also be able to use/configure the garment so that one closed position is used in conditions when soiling is likely to occur (e.g. during caregiving), and the other closed position is kept protected from soiling in those instances so that it may be used in other instances when soiling is unlikely to occur (e.g. non-caregiving circumstances or circumstances when a more professional/clean appearance may be desirable). This may allow the wearer to have two wearable configurations of the garment, one for caregiver circumstances (e.g. where soiling is likely) and one for non-caregiver circumstances (where soiling is unlikely), and to move/switch between the two positions based on circumstances.

Turning to the figures in more details, the first panel interior fastening mechanism 107 may be positioned along or in a first fastening placket/interior magnet receiving portion 109 provided adjacent the first front panel 102 (e.g. in proximity to the neckline and the shoulder area), and the first panel free edge fastening mechanism 108 may be positioned along or in a first peripheral trim band/peripheral magnet receiving portion 110 formed along an outer perimeter of the first front panel 102 and spaced apart from the first fastening placket 109 (e.g. in proximity to the neckline and the free end 121 and/or peripheral edge 125). The first panel interior fastening mechanism 107 and the first panel free edge fastening mechanism 108 (e.g. the fastening mechanisms for the front panel 102) may be couplable with corresponding fastening mechanisms provided in a second fastening placket and/or a second peripheral trim band 113 provided in the second front panel 103, as shown in FIGS. 3-4. For example, the free end fastening mechanism of one front panel may be configured to removably attach/fasten to the interior fastening mechanism of the other front panel.

By way of more specific example, the second front panel 103 may have a second panel free edge fastening mechanism 111 (which may similarly be positioned along or in a second peripheral trim band/peripheral magnet receiving portion, e.g. in proximity to the neckline and the free end/peripheral edge), and a second panel interior fastening mechanism 112 (which may similarly be positioned along or in a fastening placket/interior magnet receiving portion). In the first closed position (e.g. as shown in FIG. 1), the first panel interior fastening mechanism 107 may fasten to the second panel free edge fastening mechanism 111 (e.g. the free end of the second front panel 103 being disposed under the interior portion of the first front panel 102 and/or the two corresponding fastening mechanisms aligned one atop the other), and the first panel free edge fastening mechanism 108 may fasten to the second panel interior fastening mechanism 112 (e.g. the free end of the first front panel 102 being disposed over the interior portion of the second front panel and/or the two fastening mechanisms aligned one atop the other). In the second closed position (e.g. as shown in FIG. 5), the second panel interior fastening mechanism 112 may fasten to the first panel free edge fastening mechanism 108 (e.g. the free end of the first front panel 102 being disposed under the interior portion of the second front panel 103 and/or the two corresponding fastening mechanisms aligning one atop the other), and the second panel free edge fastening mechanism 111 may fasten to the first panel interior fastening mechanism 107 (e.g. the free end of the second front panel being disposed over the interior portion of the first front panel 102 and/or the two corresponding fastening mechanisms aligned one atop the other).

The first fastening placket 109 and second fastening placket 114 may be provided as a segment of two or more layers of fabric extending from the neck portion (e.g. neckline 127) of the respective first and second peripheral trim band 110, 113 toward/adjacent to the arm receiving portion and/or gusset of each of the first and second front panel 102, 103 (e.g. in between the shoulder and the front panel interior portion). In other words, a total of four pieces of fabric may be used to form two separate plackets (i.e., a left placket and a right placket). In an aspect, the fastening plackets 109, 114 may include a raglan seam and a front shoulder yoke seam.

With reference to FIG. 3, the second front panel 103 is equipped with corresponding fastening mechanisms for coupling to the fastening mechanisms 107, 108 of the first front panel. A second panel free edge fastening mechanism 111 is positioned along or in a second peripheral trim band 113 (e.g. disposed in proximity to the neckline and/or the free end/peripheral edge), and a second panel interior fastening mechanism 112 is positioned along or in a second fastening placket 114 (e.g. disposed in proximity to the neckline and/or shoulder). In either the first closed position (FIGS. 1 and 2) or the second closed position (FIG. 5), the first panel interior fastening mechanism and second panel free edge fastening mechanisms 107, 111 are coupled, and the first panel free edge fastening mechanism and second panel interior fastening mechanisms 108, 112 are coupled to secure the garment 100 to the wearer (e.g. forming a closed garment with a closed neckline 127 fully enclosing the wearer's neck). In the first closed position, the first front panel 102 may be fully exposed and/or may at least partially cover the second front panel 103, while in the second closed position the second front panel 103 may be fully exposed and/or may at least partially cover the first front panel 102.

The corresponding fastening mechanisms on the first front panel 102 and the second front panel 103 may be configured as pairs to allow for releasable attachment/fastening regardless of which of the corresponding fastening mechanisms of the pair is positioned atop or below the other fastening mechanism of the pair. For example, in the first closed position (as shown in FIG. 1), the second panel free edge fastening mechanism 111 of the second front panel 103 may be disposed under the first panel interior fastening mechanism 107 of the first front panel 102, and the second panel interior fastening mechanism 112 of the second front panel 103 may be disposed under the first panel free edge fastening mechanism 108 of the first front panel 102. In the second closed position, the first panel free edge fastening mechanism 108 of the first front panel 102 may be disposed under the second panel interior fastening mechanism 112 of the second front panel 103, and the first panel interior fastening mechanism 107 of the first front panel 102 may be disposed under the second panel free edge fastening mechanism 111 of the second front panel 103.

With reference to FIG. 7, which illustrates the garment 100 in or moving towards a first open position (e.g. opening up from the first closed position), the first panel free edge fastening mechanism 108 and a surrounding portion (e.g. free end portion 121) of the first front panel 102 may be lifted away from the wearer's body (and/or the second front panel 103) to separate the first front panel 102 from the second front panel 103 and to uncouple the first panel free edge fastening mechanism 108 from the second panel interior fastening mechanism 112. In some embodiments, the free end portion 121 of the first front panel 102 may be partially opened (e.g. as shown in FIG. 7, which may partially reveal the second front panel 103 and/or the underside of the first front panel 102), for example with the first panel free edge fastening mechanism 108 being uncoupled from the second panel interior fastening mechanism 112, while the front panel interior fastening mechanism 107 remains fastened/coupled to the second panel free edge fastening mechanism 111. After transitioning from the first closed position to the first open position of FIG. 7, the first panel interior fastening mechanism 107 may then be subsequently uncoupled from the second panel free edge fastening mechanism 111. From this fully open position, the first front panel 102 can be brought in towards the wearer's chest in the second open position (FIG. 4, e.g. switching which front panel is underneath), for example as the wearer switches from the first closed position to the second closed position. The corresponding fastening mechanisms may then be coupled/fastened to secure the garment in the closed position. In an aspect, a wearer may switch from the second closed position to the first closed position similarly, in reverse to the description above.

The fastening mechanism/fastener may be any device or component known for securing a clothing item depending on the needs of the application, for example and not limitation, hook and loop fastener, buttons, zippers, snaps, ties, toggles, and the like. In an aspect, the corresponding fastening mechanisms may be configured for automatically coupling. For example, each of the fastening mechanisms/fasteners of the first front panel and the second panel may be magnets configured to automatically couple when the wearer brings the first front panel 102 (containing the first panel interior fastening mechanism 107 and the first panel free edge fastening mechanism 108) in proximity to the second front panel 103 (containing the second panel free edge fastening mechanism 111 and the second panel interior fastening mechanism 112) for magnetic attraction and automatic coupling of the fastening mechanisms. The magnets of the corresponding fastening mechanisms of the first and second front panels 102, 103 may be configured so that, regardless of whichever fastening mechanism of the corresponding pair is disposed atop or below the other, the corresponding pair of fastening mechanisms will couple/fasten (e.g. by magnetic attraction).

In an aspect, the dual closure system may be installed in the garment 100 in a way that conceals the dual closure system and fastening mechanisms from external view. The first and second fastening plackets may be formed from at least two layers of fabric, including an outermost layer and an innermost layer. Each of the interior fastening mechanisms 107, 112 may be affixed to the innermost layer of the respective first and second fastening plackets, so that when the garment is worn, the fastening mechanisms are not visible (e.g. they are hidden from view) and the garment has the appearance of a typical clothing item. Similarly, the peripheral trim portions on the first front panel 102 and the second front panel 103 may be formed from at least two layers of fabric, including an outermost layer and an innermost layer. Each of the free end fastening mechanisms 108, 111 may be affixed to the innermost layer of the respective first and second peripheral trim portions, so that when the garment is worn, the fastening mechanisms are not visible and the garment has the appearance of a typical clothing item.

Figure 9:
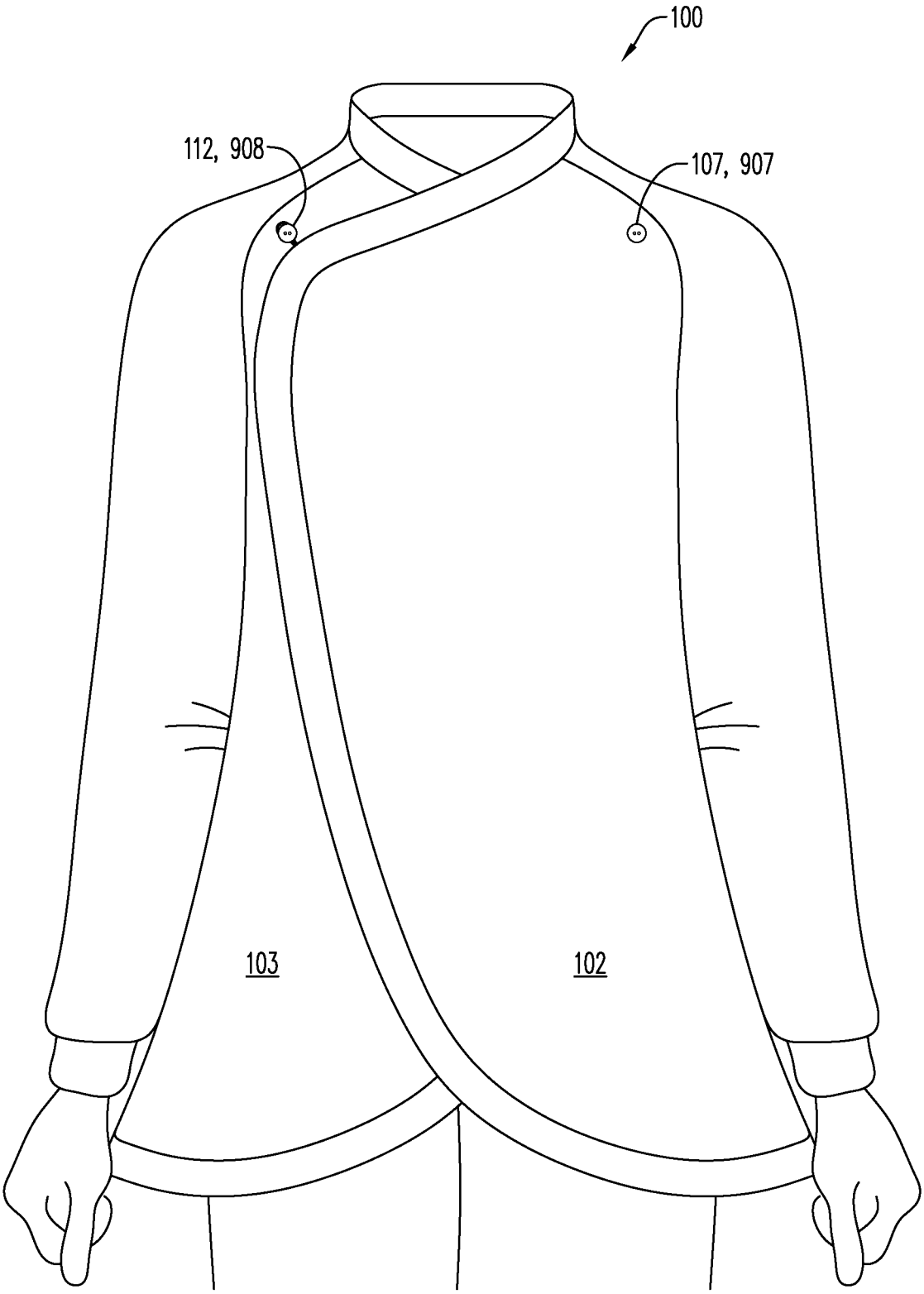
FIG. 9 is a front view of another exemplary embodiment of a garment, according to an aspect and in a first closed position.
Figure 13:
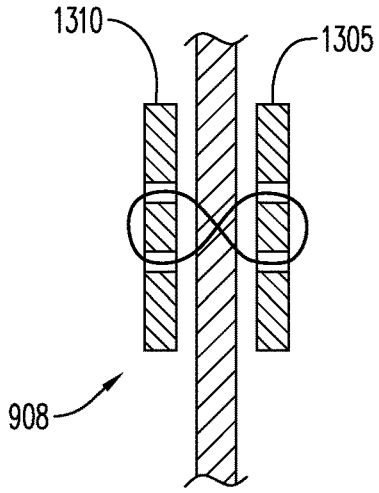
FIG. 13 illustrates an exemplary double-button for use with an embodiment.

In some embodiments, the fastening mechanism/fastener may include a double-button (e.g. as shown in FIG. 9 with the first panel interior fastening mechanism 107 of the first front panel 102 being double button 907, and the second panel interior fastening mechanism 112 being double button 908). For example, as shown in FIG. 13, the double-button 908 may include two buttons (e.g. an exterior button 1310 and an interior button 1305) which are stacked with the material/cloth of the front panel disposed therebetween (e.g. the buttons are disposed opposite each other across the material of the front panel, with the exterior button attached to the exterior surface of the front panel and the interior button attached to the interior surface of the front panel). For example, the double button 907, 908 of each front panel may include a top/exterior button 1310, disposed on the exterior surface of the front panel, and a bottom/interior button 1305, disposed on an interior surface of the front panel. The top button 1310 may be stacked atop the bottom button 1305, with the material/cloth of the front panel disposed therebetween. In some embodiments, the same attachment string/stitching may be used to fix both the top and bottom buttons of the double-button to the front panel (e.g. passing through the front panel material).

As shown in FIGS. 9-16, each of the first front panel 102 and the second front panel 103 may have a double-button 907, 908 disposed thereon (e.g. as the first panel interior fastening mechanism 107 and the second panel interior fastening mechanism 112). For example, the double-button 907, 908 may be disposed on the interior portion 123 of the front panel, typically in proximity to the top of the front panel such as in proximity to the neckline 127 and or shoulder. In some embodiments, the double-button may be attached on a placket (e.g. similar to placket 109 shown in FIG. 1), for example with the double-button being sewed onto the front panel through a double-layer portion formed by the placket material. Each of the first front panel 102 and the second front panel 103 may also have a corresponding loop (e.g. configured to fasten/couple to the corresponding double button, for example to both the top and bottom button individually) disposed thereon (e.g. as the first panel free edge fastening mechanism 108 and the second panel free edge fastening mechanism 111). For example, the loop may be disposed on the free end portion 121 of the front panel, in proximity to the peripheral edge 125 (e.g. projecting out from the peripheral edge). In some embodiments, the loop may be formed of elastic material. Alternate embodiments (not shown) may use a buttonhole instead of a loop (e.g. with the first panel free edge fastening mechanism and the second panel free edge fastening mechanism being a buttonhole, which may be disposed in proximity to the peripheral edge and/or the neckline and may be configured to fasten to the corresponding double-button).

Figure 10:
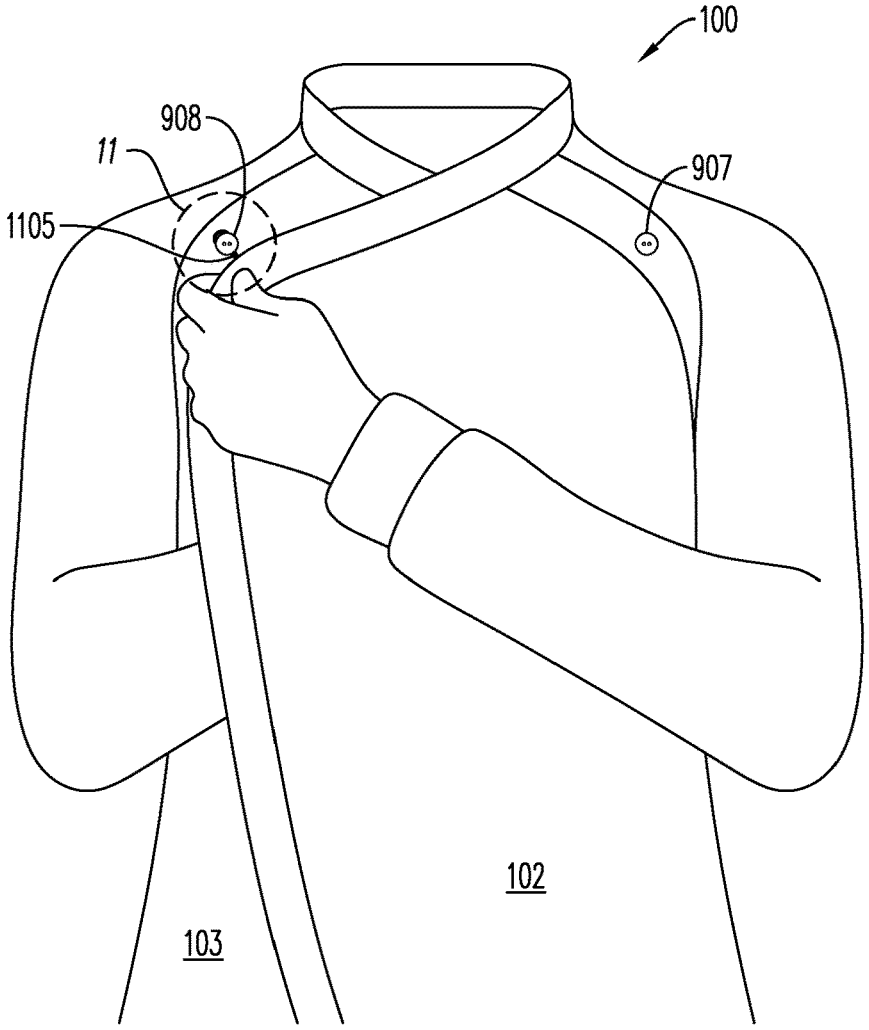
FIG. 10 is a front view of the exemplary garment in a first closed position according to an aspect.
Figure 11:
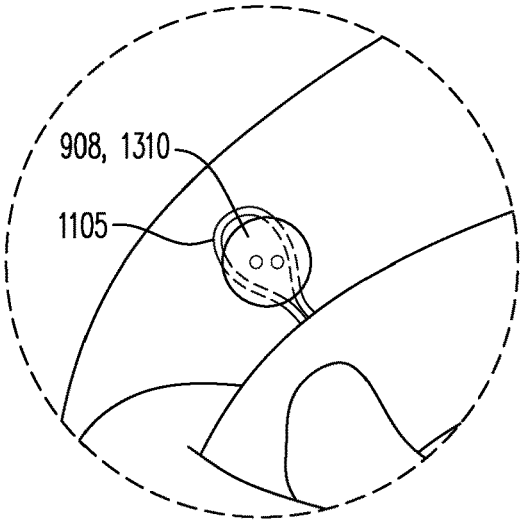
FIG. 11 illustrates in more detail a portion of FIG. 10, according to an aspect.
Figure 12:
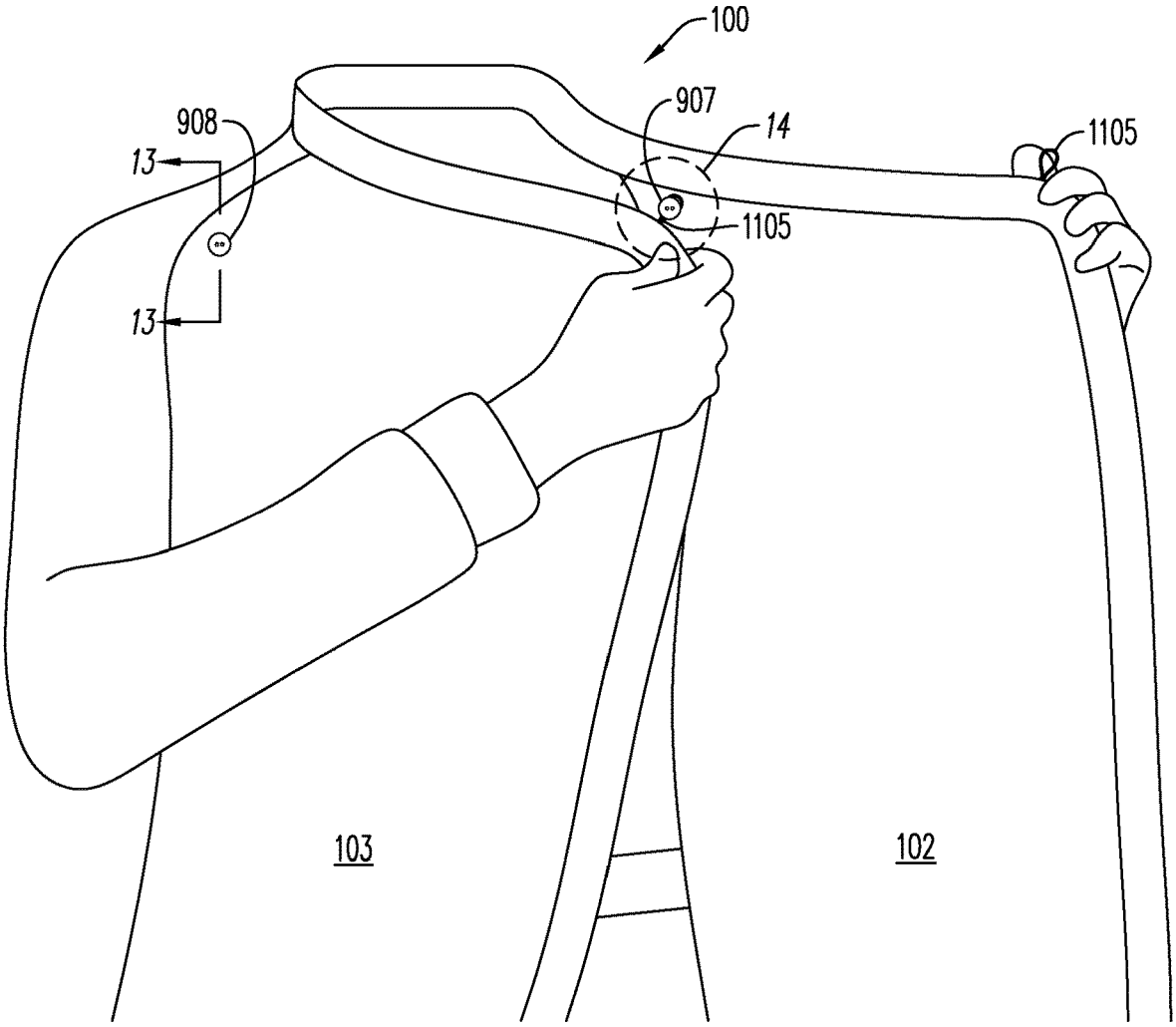
FIG. 12 is a front view of the exemplary garment in a first open position, according to an aspect.
Figure 14:
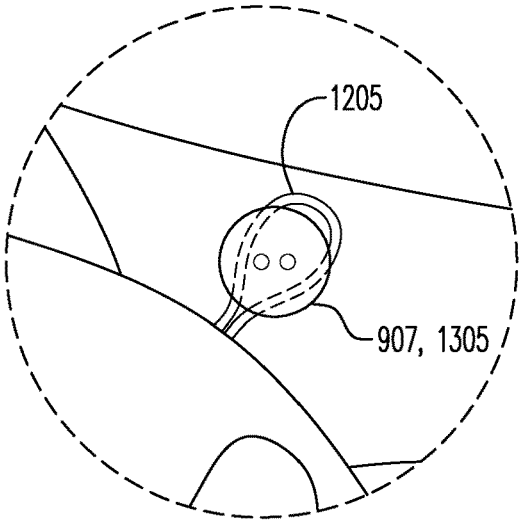
FIG. 14 illustrates in more detail a portion of FIG. 12, according to an aspect.
Figure 15:
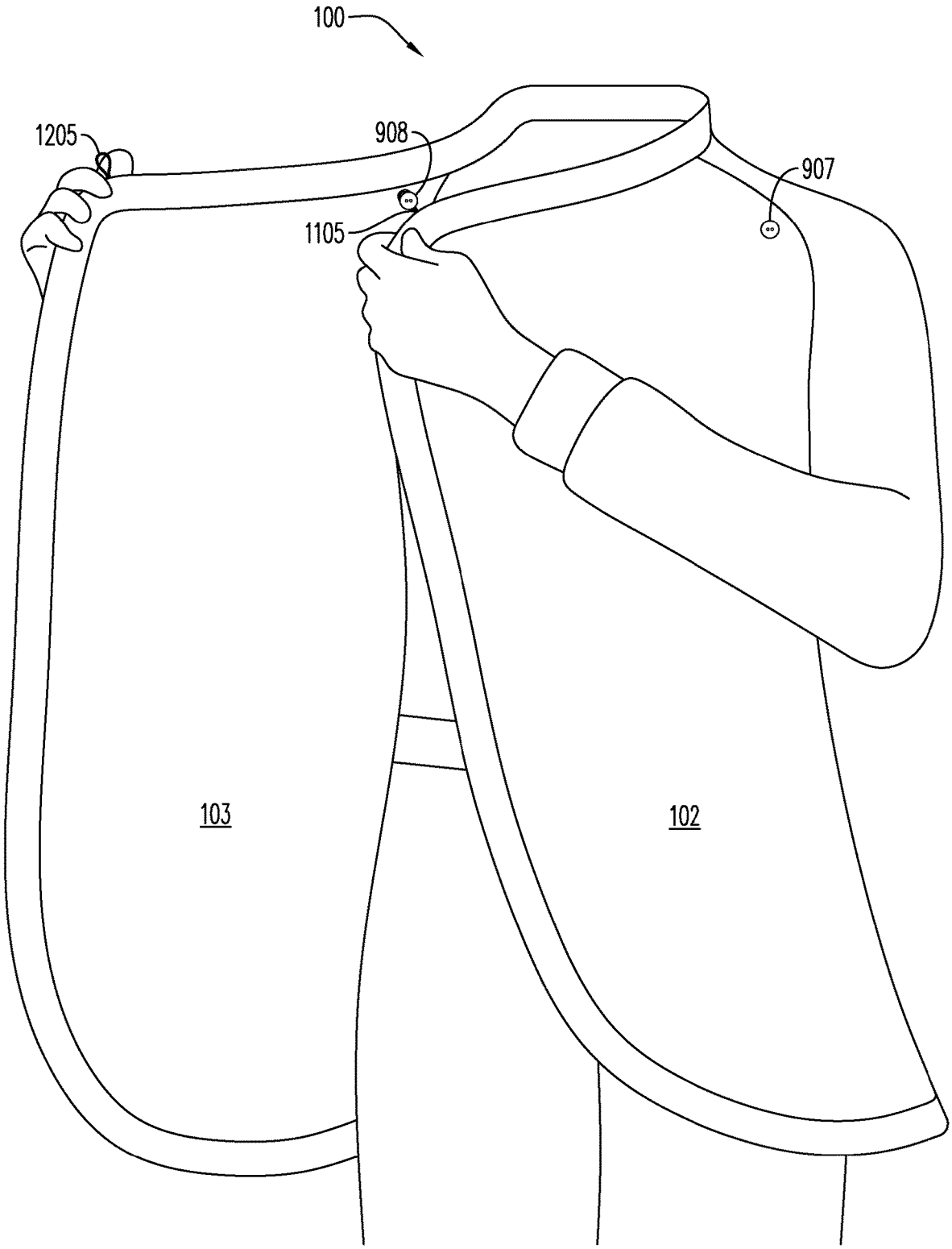
FIG. 15 is a front view of the exemplary garment in a second open position, according to an aspect.
Figure 16:
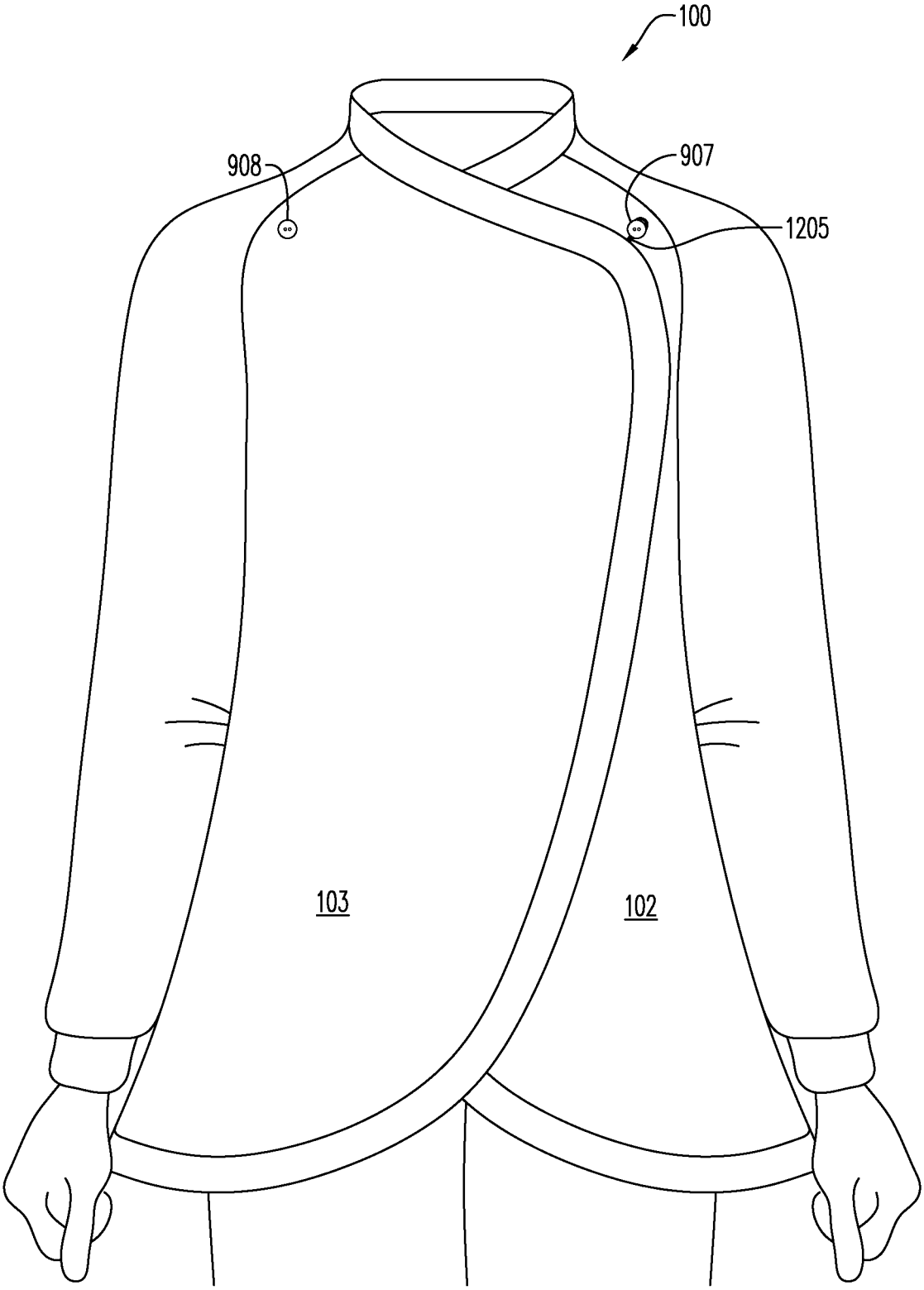
FIG. 16 is a front view of the exemplary garment in a second closed position, according to an aspect.

FIGS. 9-11 illustrates an exemplary embodiment of the garment in the first closed position, with loop 1105 of the first front panel 102 fastened/coupled to the top/exterior button 1310 of the double-button 908 serving as the second front panel 103 interior fastening mechanism. As shown in FIGS. 12 and 14, the loop 1205 of the second front panel 103 may be fastened/coupled to the bottom/interior button 1305 of the double-button 907 serving as the first front panel 102 interior fastening mechanism. FIGS. 15-16 illustrate the exemplary garment with respect to the second closed position (e.g. with FIG. 16 showing the garment in the second closed position), with the loop 1105 of the of the first front panel 102 fastened/coupled to the bottom button of the double-button 908 serving as the second front panel 103 interior fastening mechanism, and the loop 1205 of the second front panel 103 fastened/coupled to the bottom button of the double-button 907 serving as the first front panel 102 interior fastening mechanism.

In some embodiments, the material of the front panels may be absorbent. In some embodiments, the material of the front panels may be liquid (e.g. water) resistant. In some embodiments, the material of the front panel may be coated with a liquid/water repellant coating. In some embodiments, each of the front panels may be formed of a single layer of material. In other embodiments, each of the front panels may be formed of two layers of material. In some embodiments, the front panels may have an absorbent exterior layer and an interior layer which resists penetration by liquid (e.g. is water resistant). In some embodiments, the front panels may be formed of material that is breathable. In some embodiments, the front panels may be formed of material that is soft to the touch. In some embodiments, one or both front panels may include terry cloth. In some embodiments, both front panels may be formed of the same material. In other embodiments, the two front panels may be formed of different material. In some embodiments, the garment may be reversible (e.g. configured to be worn with either side out). In some embodiments, the exterior/top and the interior/underside of each front panel may have a different color and/or pattern. In some embodiments, the garment may be configured as a wrap shirt, coat, or dress, which may be worn in either of two closed positions and removably fastened into closed position. In some embodiments, the fastening mechanisms may be configured to allow for one-handed use by the wearer (e.g. capable of being uncoupled and/or coupled using one hand). In some embodiments, the garment may be fastened in the closed positions without any additional and/or separate element, such as a belt.

Figure 6:
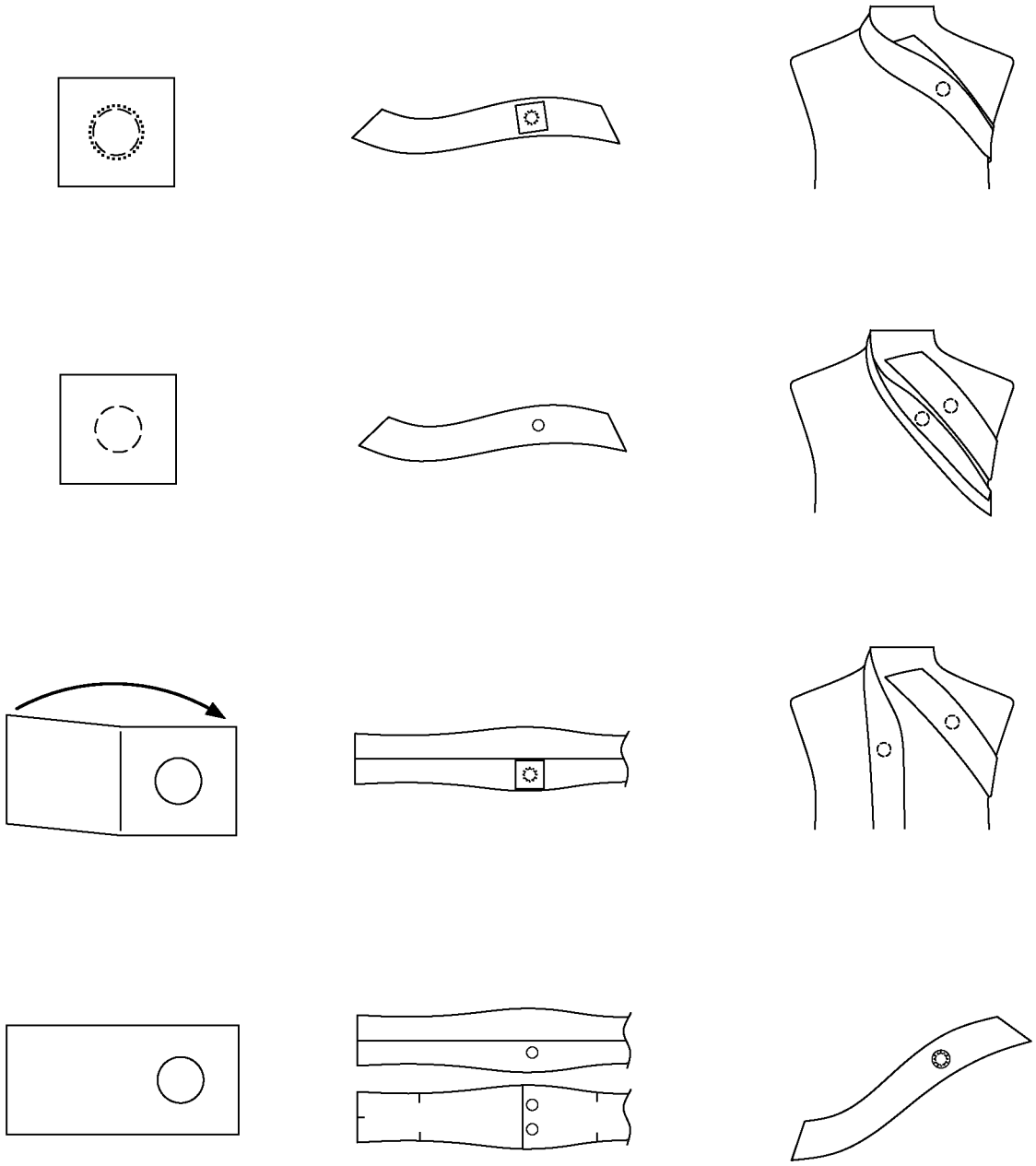
FIG. 6 illustrates a method of manufacturing and installing a dual fastening assembly for use with an embodiment, according to an aspect.

FIG. 6 details a method of preparing and installing the dual closure system according to the exemplary embodiment and as described above. Each of the four fastening mechanisms (i.e., first top fastening mechanism, second top fastening mechanism, first bottom fastening mechanism, and second bottom fastening mechanism), for example, the four magnet components, may be secured in a fastening mechanism pocket (e.g., magnet pocket). The magnet pocket may be made from a fabric material, for example, cotton poplin, and may further be block fused (by the attachment of interface to the fabric prior to cutting for specific pattern pieces) for added structure and stability of the pocket. The size of the pocket may be customized to securely fit the fastening mechanism. For example, the size of the pocket may be 1¾" by 3" to securely fit a magnet therein. The cut pocket fabric piece may then be creased down a centerline, and the magnet may be placed on a first side of the fabric piece. The opposite second side of the cut pocket fabric piece may be folded over the magnet and secured to the first side, for example, using a single needle stitch, thereby forming the magnet pocket.

As discussed above and with further reference to FIG. 6, two peripheral trim fabric pieces may be cut from a pattern that is twice the width of the finished peripheral trim portion, and each may be marked with the position of one of the second top fastening mechanism and the second bottom fastening mechanism. The fabric pieces may be fused for added stability and structure. One magnet pocket and magnet is stitched to one side of each peripheral trim fabric piece at the marked location. The stitching may follow the outline or profile of the magnet. The opposite side of each peripheral trim fabric piece may be folded over the magnet pocket and magnet, and secured to the first side, for example, using a single needle stitch, to create a peripheral trim portion with an outermost layer and an innermost layer of fabric, with the magnet pocket and magnet stitched to the innermost layer.

Two fastening placket fabric portions may be cut from a pattern and each may be marked with the position of one of the first top fastening mechanism and the first bottom fastening mechanism. The fabric pieces may be fused for added stability and structure. One magnet pocket and magnet may be stitched to the marked location on each fastening placket fabric portion. The magnet pocket may then be trimmed to the profile or shaped of the magnet, for example, down to a 3/16" lip. When the garment is fully assembled, in a first closed position, the innermost layer of the peripheral trim portion of the first front panel is in direct contact with the fastening placket of the second front portion. In a second closed position, the innermost layer of the peripheral trim portion of the second front panel is in direct contact with the fastening placket of the first front portion. The placement of each respective fastening mechanism allows for dual closure in a first closed position and in a second closed position, while concealing the closure system within the fabric layers of the garment and providing a tactile indication to the wearer of the position of the fastening mechanisms for coupling together and securing the garment.

Figure 8:
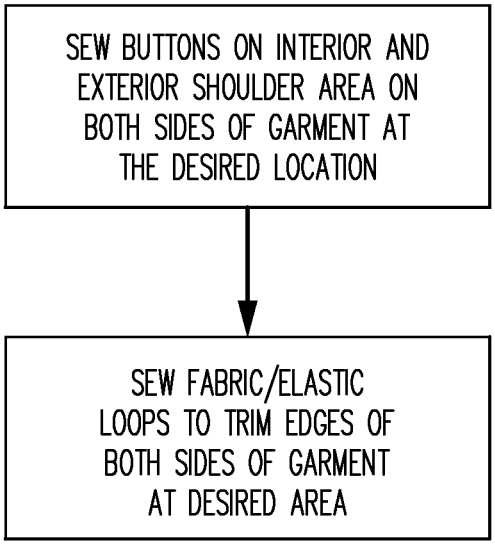
FIG. 8 is a flowchart illustrating an exemplary method of making double-button fastening mechanisms for exemplary garments, according to an aspect.

FIG. 8 illustrates an exemplary method for forming and/or attaching the double-button fastening mechanism/system on the front panels. For example, matching (e.g. size and shape) buttons may be sewed or otherwise attached on the interior and exterior of the front panel, e.g. in proximity to the shoulder area (e.g. sewing or affixing buttons on the interior and exterior surface of the interior portion of each of the front panels, for example in proximity to the neckline and/or the shoulder). The top and bottom buttons of the double-button may be stacked, with the cloth of the front panel therebetween. A loop may also be sewed or otherwise attached to the front panel (e.g. at the free end) (e.g. sewing or affixing loops configured to correspond to the double-button to an edge (e.g. the peripheral edge) of each front panel at the desired location, such as in proximity to the neckline). The loop may be sized to correspond to the double-button for fastening.

This disclosure, in various embodiments, configurations and aspects, includes components, methods, processes, systems, and/or apparatuses as depicted and described herein, including various embodiments, sub-combinations, and subsets thereof. This disclosure contemplates, in various embodiments, configurations and aspects, the actual or optional use or inclusion of, e.g., components or processes as may be well-known or understood in the art and consistent with this disclosure though not depicted and/or described herein. The claims which follow are intended as part of this specification, and are expressly incorporated by reference herein.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. Such approximating language may refer to the specific value and/or may include a range of values that may have the same impact or effect as understood by persons of ordinary skill in the art field. For example, approximating language may include a range of +/−10%, +/−5%, or +/−3%. In some instances, the approximating language may correspond to the precision of an instrument for measuring the value. Terms such as "first," "second," "upper," "lower," "top," "bottom," "inner"/"innermost", and "outer"/"outermost," etc., are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that the appended claims should cover variations in the ranges except where this disclosure makes clear the use of a particular range in certain embodiments.

The terms "determine", "calculate" and "compute," and variations thereof, as used herein, are used interchangeably and include any type of methodology, process, mathematical operation or technique.

This disclosure is presented for purposes of illustration and description. This disclosure is not limited to the form or forms disclosed herein. In the Detailed Description of this disclosure, for example, various features of some exemplary embodiments are grouped together to representatively describe those and other contemplated embodiments, configurations, and aspects, to the extent that including in this disclosure a description of every potential embodiment, variant, and combination of features is not feasible. Thus, the features of the disclosed embodiments, configurations, and aspects may be combined in alternate embodiments, configurations, and aspects not expressly discussed above. For example, the features recited in the following claims lie in less than all features of a single disclosed embodiment, configuration, or aspect. Thus, the following claims are hereby incorporated into this Detailed Description, with each claim standing on its own as a separate embodiment of this disclosure.

Advances in science and technology may provide variations that are not necessarily express in the terminology of this disclosure although the claims would not necessarily exclude these variations.

What is claimed is:

1. A garment comprising:

a first front panel;

a second front panel;

a back panel;

a first arm sleeve; and a second arm sleeve wherein:

each of the first front panel and the second front panel comprises a neckline and a lower edge spaced apart from the neckline by a length;

each of the first front panel and the second front panel comprises an interior portion adjacent a lateral side edge and a peripheral edge spaced apart from the lateral side edge by a width;

the interior portion of the first front panel is adjacent to a first side of the back panel, and the interior portion of the second front panel is adjacent to a second side of the back panel;

the first front panel and the second front panel are substantially symmetrical to each other;

the garment has a first closed position and a second closed position;

the garment is repositionable between the first closed position, in which the first front panel is releasably fastened to and covers at least a portion of an exterior surface of the second front panel, and the second closed position in which the second front panel is releasably fastened to and covers at least a portion of an exterior surface of the first front panel.

2. The garment of claim 1, wherein each of the first front panel and the second front panel further comprises a free end portion disposed in proximity to the peripheral edge, and wherein the garment is further repositionable to an open position in which the free end portion of the first front panel is not fastened to the second front panel, and the free end portion of the second front panel is not fastened to the first front panel.

3. The garment of claim 1, wherein each of the first front panel and the second front panel comprise two releasable fasteners, and one of the two releasable fasteners of the first front panel is configured to releasably fasten to one of the two releasable fasteners on the second front panel.

4. The garment of claim 1, wherein each of the first front panel and the second front panel comprise two releasable fasteners, and one of the releasable fasteners of each of the first front panel and the second front panel are disposed in proximity to the neckline.

5. The garment of claim 1, wherein, in both the first closed position and the second closed position, an upper area of the first front panel and the second front panel are configured to be releasably attached together, while a lower area of the first front panel and the second front panel are configured to hang freely; wherein the upper area is disposed in proximity to the neckline, and the lower area is spaced apart from the neckline by the upper area.

6. The garment of claim 3, wherein:

the two releasable fasteners for the first front panel comprise a first panel interior fastener and a first panel free edge fastener;

the first panel interior fastener is disposed on the first front panel in proximity to the neckline;

the first panel free edge fastener is disposed in proximity to the peripheral edge of the first front panel;

the two removable fasteners for the second front panel comprise a second panel interior fastener and a second panel free edge fastener;

the second panel interior fastener is disposed on the second front panel in proximity to the neckline;

the second panel free edge fastener is disposed in proximity to the peripheral edge of the second front panel;

the first panel interior fastener is configured to releasably fasten to the second panel free edge fastener in both the first closed position and the second closed position; and the first panel free edge fastener is configured to releasably fasten to the second panel interior fastener in both the first closed position and the second closed position.

7. The garment of claim 6, wherein:

the first panel interior fastener comprises a first double-button having an exterior button stacked atop an interior button with the first front panel disposed therebetween;

the second panel interior fastener comprises a second double-button having an exterior button stacked atop an interior button with the second front panel disposed therebetween;

the first panel free edge fastener comprises a first loop configured to releasably fasten to the second double-button; and the second panel free edge fastener comprises a second loop configured to releasably fasten to the first double-button.

8. The garment of claim 3, wherein each of the two releasable fasteners for each of the first front panel and the second front panel are magnets, and the releasable fasteners of the first front panel are configured to fasten to corresponding releasable fasteners of the second front panel.

9. The garment of claim 1, wherein in the first closed position, the first front panel covers 50-90% of the second front panel.

10. The garment of claim 1, wherein:

each of the first front panel and the second front panel further comprises a free end portion disposed in proximity to the peripheral edge; and in the first closed position, the first front panel covers substantially the entire exterior surface of the free end portion of the second front panel, in the second closed position, the second front panel covers substantially the entire exterior surface of the free end portion of the first front panel.

11. The garment of claim 1, wherein for each of the first front panel and the second front panel, the lower edge is configured to be disposed at or below a waist of a wearer.

12. The garment of claim 1, wherein for each of the first front panel and the second front panel, the peripheral edge curves from the neckline to the lower edge.

13. A garment comprising:

a first front panel; and a second front panel;

a first arm sleeve;

a second arm sleeve;

wherein:

each of the first front panel and the second front panel comprises a neckline and a lower edge spaced apart from the neckline by a length;

each of the first front panel and the second front panel comprises an interior portion adjacent a lateral side edge and a peripheral edge spaced apart from the lateral side edge by a width;

the garment has a first closed position and a second closed position;

the garment is repositionable between the first closed position in which the first front panel is releasably fastened to and covers at least a portion of an exterior surface of the second front panel, and the second closed position in which the second front panel is releasably fastened to and covers at least a portion of an exterior surface of the first front panel; each of the first front panel and the second front panel comprise two releasable fasteners.

14. The garment of claim 13, wherein the width of each of the first front panel and the second front panel at the neckline is greater than the width at the lower edge.

15. The garment of claim 13, wherein the first front panel and the second front panel are substantially symmetrical.

16. A garment comprising:

a first front panel;

a second front panel;

a first arm sleeve; and a second arm sleeve;

wherein:

each of the first front panel and the second front panel comprises a neckline and a lower edge spaced apart from the neckline by a length;

each of the first front panel and the second front panel comprises an interior portion adjacent a lateral side edge and a peripheral edge spaced apart from the lateral side edge by a width;

the first arm sleeve is disposed adjacent to the interior portion of the first front panel;

the second arm sleeve is disposed adjacent to the interior portion of the second front panel; and the garment has a first closed position and a second closed position;

the garment is repositionable between the first closed position in which the first front panel is releasably fastened to and covers at least a portion of an exterior surface of the second front panel, and the second closed position in which the second front panel is releasably fastened to and covers at least a portion of an exterior surface of the first front panel.

17. The garment of claim 16, wherein each of the first front panel and the second front panel comprise two releasable fasteners, the two releasable fasteners of the first front panel are configured to releasably fasten to corresponding two releasable fasteners on the second front panel in both the first closed position and the second closed position, and the releasable fasteners of each of the first front panel and the second front panel are disposed in proximity to the neckline.

18. The garment of claim 16, wherein in the first closed position, the first front panel covers approximately 70-90% of the second front panel.

19. The garment of claim 16, wherein:

each of the first front panel and the second front panel further comprises a free end portion disposed in proximity to the peripheral edge;

in the first closed position, the first front panel covers substantially a top half of the exterior surface of the free end portion of the second front panel; and in the second closed position, the second front panel covers substantially a top half of the exterior surface of the free end portion of the first front panel.

* * * * *